US008307884B2

(12) United States Patent
Yukutomo et al.

(10) Patent No.: US 8,307,884 B2
(45) Date of Patent: Nov. 13, 2012

(54) DIE CASTING MACHINE

(75) Inventors: Hiroshi Yukutomo, Akashi (JP); Akio Yamada, Akashi (JP)

(73) Assignee: Toyo Machinery & Metal Co., Ltd., Akashi-shi (JP)

( * ) Notice: Subject to any disclaimer, the term of this patent is extended or adjusted under 35 U.S.C. 154(b) by 32 days.

(21) Appl. No.: 13/055,794

(22) PCT Filed: Jul. 27, 2009

(86) PCT No.: PCT/JP2009/063345

§ 371 (c)(1),
(2), (4) Date: Jan. 25, 2011

(87) PCT Pub. No.: WO2010/013674

PCT Pub. Date: Feb. 4, 2010

(65) Prior Publication Data

US 2011/0114281 A1 May 19, 2011

(30) Foreign Application Priority Data

Jul. 29, 2008 (JP) ..... 2008-195121

(51) Int. Cl.
*B22D 17/00* (2006.01)
*B22D 17/32* (2006.01)

(52) U.S. Cl. ..... 164/312; 164/315

(58) Field of Classification Search ..... 164/306, 164/312, 313, 314, 315, 303
See application file for complete search history.

(56) References Cited

U.S. PATENT DOCUMENTS 7,717,159 B2 * 5/2010 Tsuji et al. ..... 164/312

FOREIGN PATENT DOCUMENTS

| | | | |
|---|---|---|---|
| JP | 2001-1126 A | | 1/2001 |
| JP | 2001-95287 A | * | 4/2001 |
| JP | 2006-315072 A | | 11/2006 |
| JP | 2008-73708 A | | 4/2008 |
| JP | 2008-155280 A | | 7/2008 |
| WO | WO 2008/035805 A1 | | 3/2008 |

OTHER PUBLICATIONS

International Search Report dated Oct. 13, 2009 including English-language translation (Two (2) pages).

* cited by examiner

*Primary Examiner* — Kevin P Kerns
(74) *Attorney, Agent, or Firm* — Crowell & Moring LLP

(57) ABSTRACT

A die casting machine provided with an electric servomotor and a hydraulic cylinder as drive sources for injection is enhanced in operation stability in an injection step. In the injection step, the rotational speed of an injection electric servomotor (3) is pattern-controlled to follow a preset speed command pattern while the forward speed of a piston (5*a*) caused by driving of an injection hydraulic cylinder (5) is feedback-controlled with an addition signal of the forward speed of the piston (5*a*) caused by driving of the injection electric servomotor (3) and the forward speed of the piston (5*a*) caused by driving of the injection hydraulic cylinder (5). Alternatively, the forward speed of the piston (5*a*) caused by driving of the injection hydraulic cylinder (5) may be pattern-controlled to follow a preset speed command pattern while the rotational speed of the injection electric servomotor (3) is feedback-controlled with the addition signal.

3 Claims, 4 Drawing Sheets

(a)

(b)

+

(c)

||

DIE CASTING MACHINE

TECHNICAL FIELD

The present invention relates to a die casting machine, and particularly relates to a method for controlling driving of an electric servomotor and a hydraulic cylinder in a hybrid type die casting machine including the electric servomotor and the hydraulic cylinder as drive sources for injection.

BACKGROUND ART

In a die casting machine, a molten metal material (metal melt) such as an Al alloy or a Mg alloy melted in a melting furnace is measured and scooped every shot by a ladle. The scooped metal melt is poured into an injection sleeve. The metal melt is then injected/filled into a cavity of a mold in accordance with forward movement of an injection plunger. Thus, a product is obtained. The casting procedure of the die casting machine includes an injection step consisting of a low-speed injection step and a high-speed injection step following the low-speed injection step, and a pressure intensification step following the injection step. Since the metal melt is solidified more easily than a plastic material, the high-speed injection step requires a higher injection speed than that of injection molding of the plastic material, and the pressure intensification step requires a higher pressure than that of injection molding of the plastic material.

For this reason, when only an electric servomotor is used as a drive source for injection in the same manner as in an injection molding machine for a plastic material, a high-power electric servomotor is required. Thus, not only are the cost and power consumption of the machine are increased, but also the scale of a rotor in the motor is increased to cause increase in the inertia force. As a result, there also arises a problem that the responsiveness deteriorates.

In order to solve such a problem, there has been heretofore proposed a die casting machine in which both an electric servomotor and a hydraulic cylinder are provided as drive sources for injection, and a low-speed injection step and a high-speed injection step are performed by driving of only the electric servomotor while a pressure boosting operation is performed by driving of only the hydraulic cylinder (for example, see Patent Document 1). According to this die casting machine, the power shortage of the electric servomotor can be compensated by the hydraulic cylinder. Thus, high boosting pressure can be provided by use of the comparatively low-power electric servomotor.

PRIOR TECHNICAL DOCUMENT

Patent Document

Patent Document 1: JP-A-2001-1126

SUMMARY OF THE INVENTION

Problem that the Invention is to Solve

According to the technique disclosed in Patent Document 1, the low-speed injection step and the high-speed injection step are carried out by driving of only the electric servomotor, while the pressure keeping operation is carried out by driving of only the hydraulic cylinder. Therefore, there is a room for improvement to miniaturize the electric servomotor because the power of the hydraulic cylinder cannot be used for executing the injection steps. That is, when the low-speed injection step and the pressure intensification step are carried out by driving of only the electric servomotor while the high-speed injection step is carried out by driving of both the electric servomotor and the hydraulic cylinder, use of a lower-power electric servomotor is feasible and advantageous to reduction in the cost and the power of the machine and improvement in the responsiveness of the machine.

According to experiments of the present inventors, it has been, however, proved that when the high-speed injection step using both driving of the electric servomotor and driving of the hydraulic cylinder is switched to the pressure intensification step using driving of only the electric servomotor, a reaction force of the hydraulic cylinder acts on the electric servomotor during the high-power rotational driving of the electric servomotor, thereby causing a problem that the electric servomotor oscillates so that the boosting pressure becomes unstable.

The present invention was developed in consideration of the aforementioned knowledge. An object of the invention is to provide a die casting machine which has an electric servomotor and a hydraulic cylinder as drive sources for injection, and which has high operation stability in an injection step.

Means for Solving the Problems

In order to attain the object, according to a first configuration of the invention, there is provided a die casting machine including: an injection electric servomotor; an injection hydraulic cylinder which has a piston; a ball screw mechanism which converts rotational motion of the injection electric servomotor into rectilinear motion and transmits the rectilinear motion to the injection hydraulic cylinder; and a control unit which controls driving of the injection electric servomotor and driving of the injection hydraulic cylinder so as to sequentially execute an injection step including a low-speed injection step and a high-speed injection step following the low-speed injection step, and a pressure intensification step following the injection step; wherein: the control unit controls the driving of the injection electric servomotor and the driving of the injection hydraulic cylinder during execution of the injection step so that an addition speed of a forward speed of the piston moved in accordance with a rotational speed of the injection electric servomotor and a forward speed of the piston moved in accordance with the driving of the injection hydraulic cylinder can reach an intended speed of the piston.

With this configuration, both the driving of the injection electric servomotor and the driving of the injection hydraulic cylinder are controlled by the control unit during the execution of the injection step so that the set value of the output power of the injection electric servomotor in the injection step can be reduced due to the contribution of the injection hydraulic cylinder. Accordingly, even if a large reaction force caused by the driving of the injection hydraulic cylinder acts on the injection electric servomotor when the high-speed injection step is switched to the pressure intensification step, the injection electric servomotor does not oscillate so that the boosting pressure can be kept stable.

According to a second configuration of the invention, there is provided a die casting machine in the first configuration, wherein: the control unit pattern-controls the rotational speed of the injection electric servomotor to follow a preset speed command pattern while feedback-controlling the forward speed of the piston caused by the driving of the injection hydraulic cylinder with an addition signal of the forward speed of the piston caused by the driving of the injection electric servomotor and the forward speed of the piston caused by the driving of the injection hydraulic cylinder.

With this configuration, the forward speed of the piston caused by the driving of the injection hydraulic cylinder is feedback-controlled with an addition signal of the forward speed of the piston caused by the driving of the injection electric servomotor and the forward speed of the piston caused by the driving of the injection hydraulic cylinder. Accordingly, the rotational speed of the injection electric servomotor when the high-speed injection step is switched to the pressure intensification step can be set at a sufficiently low value. It is therefore possible to prevent the injection electric servomotor from oscillating due to an executively high rotational speed of the injection electric servomotor when the high-speed injection step is switched to the pressure intensification step, and hence to prevent the boosting pressure from fluctuating inappropriately due to the oscillation of the injection electric servomotor.

According to a third configuration of the invention, the control unit pattern-controls the forward speed of the piston caused by the driving of the injection hydraulic cylinder to follow a preset speed command pattern while feedback-controlling the rotational speed of the injection electric servomotor with an addition signal of the forward speed of the piston caused by the driving of the injection electric servomotor and the forward speed of the piston caused by the driving of the injection hydraulic cylinder.

With this configuration, the rotational speed of the injection electric servomotor is feedback-controlled with an addition signal of the forward speed of the piston caused by the driving of the injection electric servomotor and the forward speed of the piston caused by the driving of the injection hydraulic cylinder. Accordingly, the forward speed of the piston can be feedback-controlled with high precision.

Effect of the Invention

According to the invention, both the driving of the injection electric servomotor and the driving of the injection hydraulic cylinder are controlled in the injection step, so that the output power of the injection electric servomotor in the injection step can be reduced due to the contribution of the injection hydraulic cylinder. Thus, the injection electric servomotor can be prevented from oscillating when the high-speed injection step is switched to the pressure intensification step.

MODE FOR CARRYING OUT THE INVENTION

Figure 1:
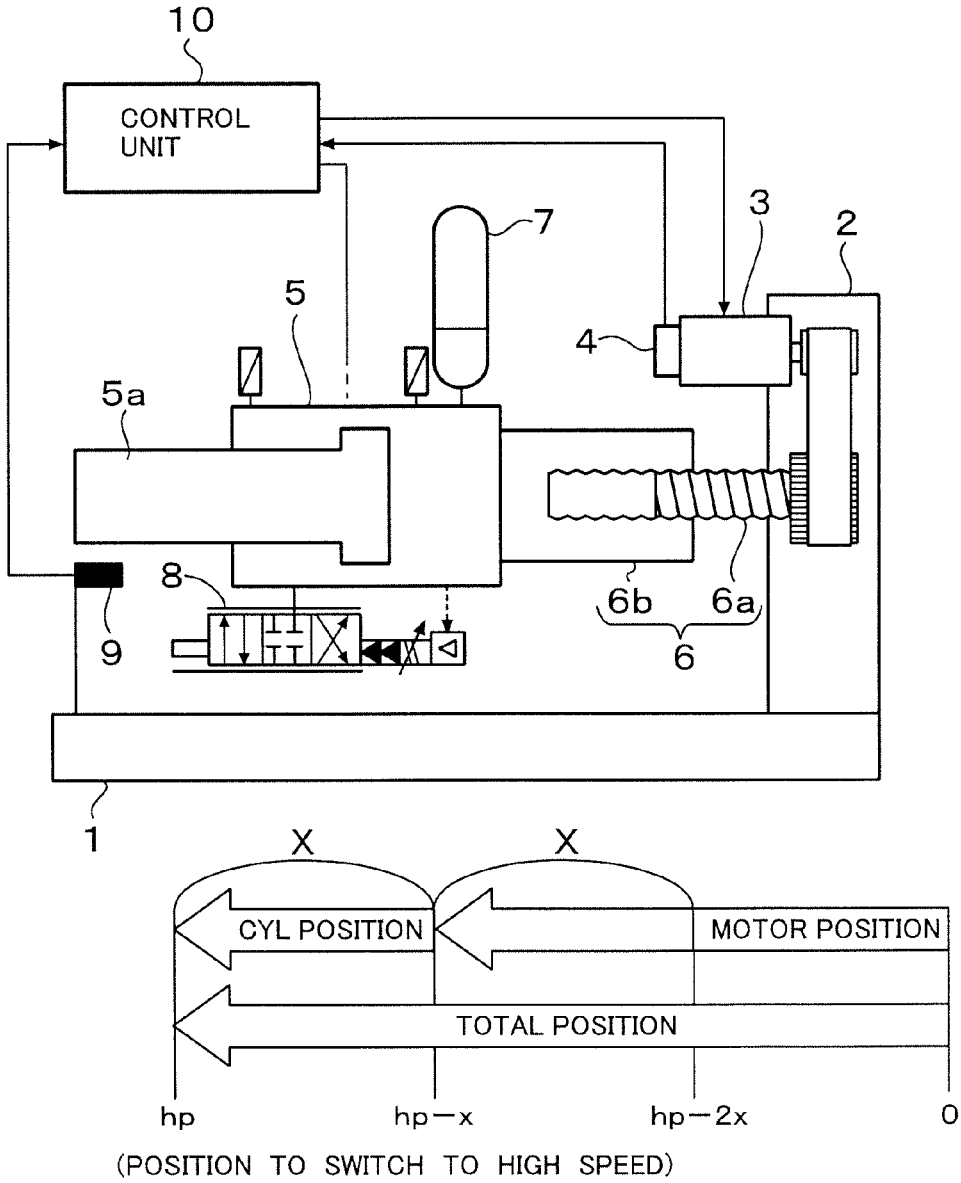
FIG. 1 A configuration view of an injection unit provided in a die casting machine according to the invention.
Figure 2:
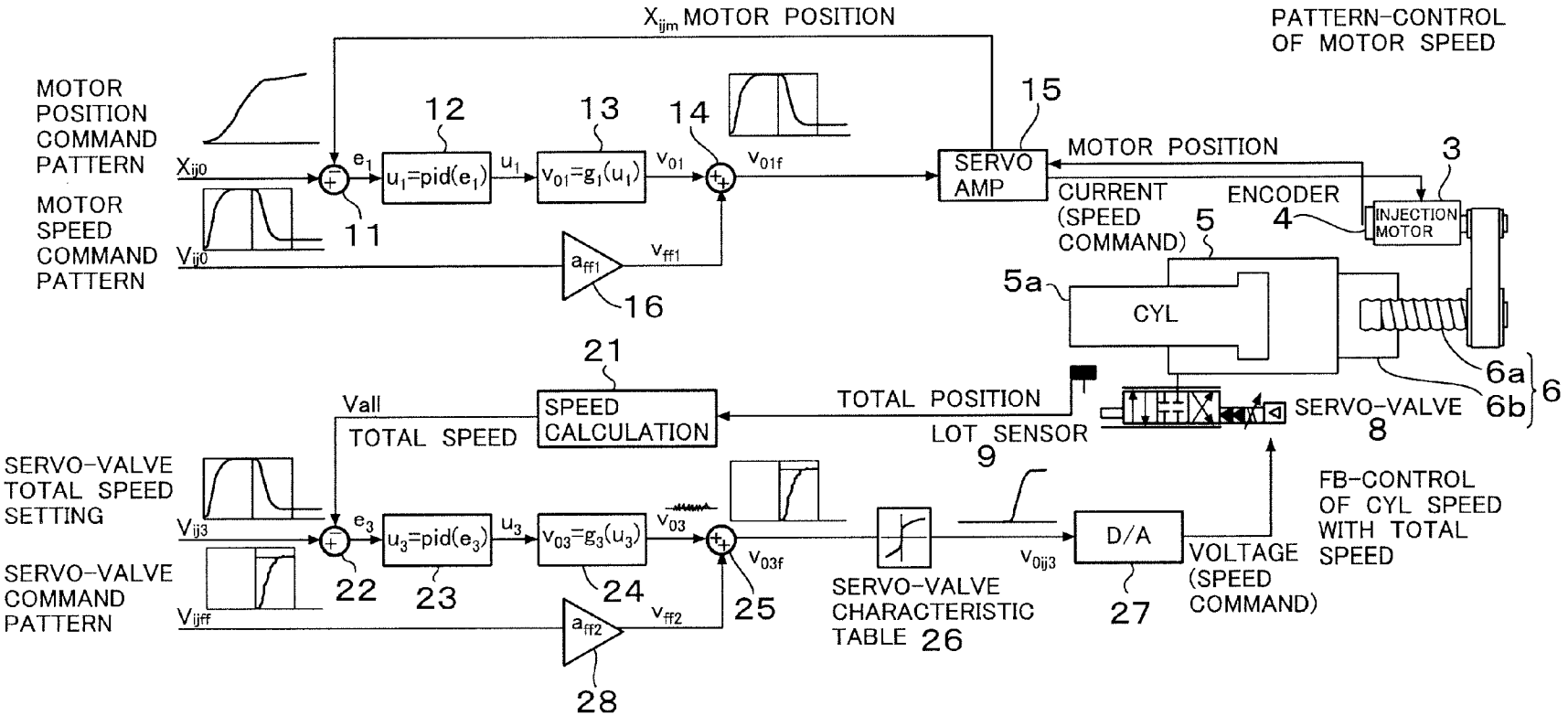
FIG. 2 A control block diagram of a control unit of the die casting machine according to a first embodiment.
Figure 3:
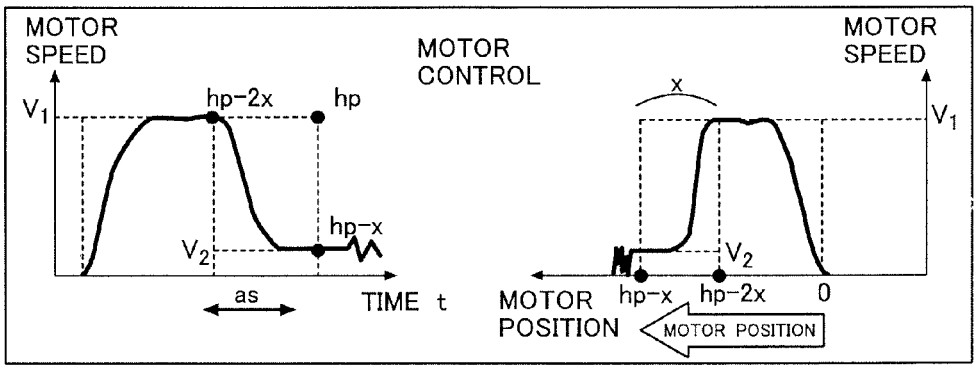
FIG. 3 A graph for explaining fluctuations of various values to be controlled by the control unit shown in FIG. 2.
Figure 3:
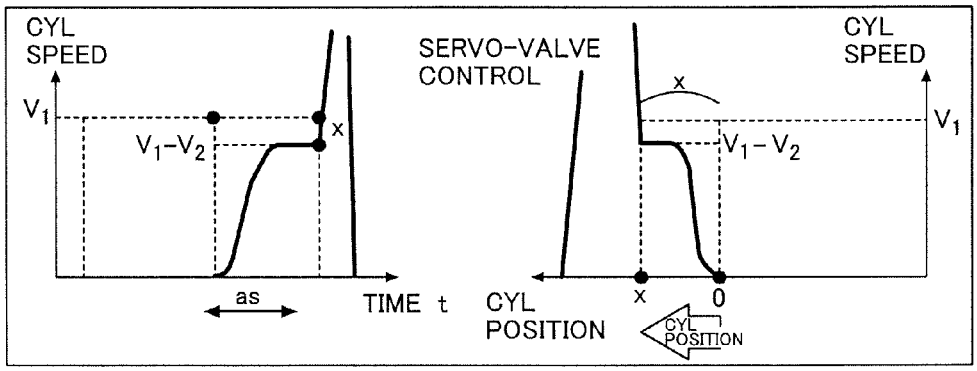
Figure 3:
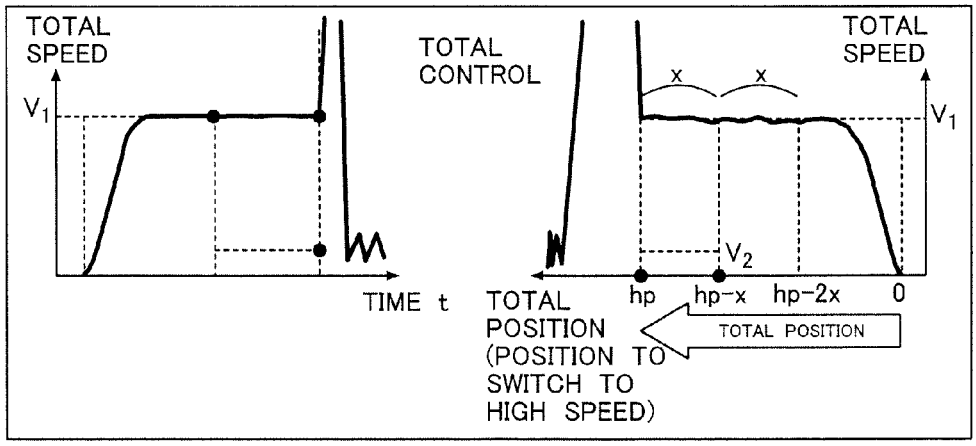

A first embodiment of a die casting machine according to the invention will be described below with reference to FIGS. 1 to 3. FIG. 1 is a configuration view of an injection unit provided in a die casting machine according to the invention. FIG. 2 is a control block diagram of a control unit of the die casting machine according to the first embodiment. FIG. 3 is a graph for explaining fluctuations of various values to be controlled by the control unit shown in FIG. 2.

As shown in FIG. 1, the injection unit of the die casting machine according to the invention includes a base 1 disposed horizontally, a motor mounting plate 2 fixed onto the base 1, an injection electric servomotor 3 mounted on the motor mounting plate 2, an encoder 4 for detecting the rotational position of the injection electric servomotor 3, an injection hydraulic cylinder 5 having a piston 5*a* disposed in parallel with the base 1, a ball screw mechanism 6 for converting the rotational motion of the injection electric servomotor 3 into rectilinear motion and transmitting the rectilinear motion to the injection hydraulic cylinder 5, an accumulator 7 for accumulating pressure oil to be supplied to the injection hydraulic cylinder 5, a servo-valve 8 for controlling the supply of the pressure oil to the injection hydraulic cylinder 5, a lot sensor 9 provided on the base 1 and for detecting a front end position of the piston 5*a*, and a control unit 10 for fetching output signals of the encoder 4 and the lot sensor 9 and controlling driving of the injection electric servomotor 3 and the injection hydraulic cylinder 5. The ball screw mechanism 6 includes a screw shaft 6*a* rotatably attached to the motor mounting plate 2 so as to be rotationally driven by the injection electric servomotor 3, and a nut body 6*b* fixed to the injection hydraulic cylinder 5 and screwed on the screw shaft 6*a*.

Incidentally, a not-shown injection plunger is connected to the front end of the piston 5*a*, and a front end portion of the injection plunger is slidably received in a sleeve provided in a not-shown fixed die plate. A melt injection hole communicating with the inside of the sleeve is provided in the fixed die plate. Melt is injected into the sleeve through the melt injection hole in the state where the injection plunger (piston 5*a*) has been moved back. When the injection plunger is then moved forward, the melt injected into the sleeve is injected into a clamped mold through a runner provided in a fixed mold. Thus, a molded product with a desired shape is die-cast.

In the injection unit according to the invention, as described above, the injection electric servomotor 3 and the injection hydraulic cylinder 5 are provided as injection drive sources for driving the injection plunger (piston 5*a*). When the injection electric servomotor 3 is driven alone, the piston 5*a* can be moved forward at a speed corresponding to the rotational speed of the injection electric servomotor 3. When the injection hydraulic cylinder 5 is driven alone, the piston 5*a* can be moved forward at a speed corresponding to the opening degree of the servo-valve 8. When the injection electric servomotor 3 and the injection hydraulic cylinder 5 are driven concurrently, the piston 5*a* can be moved forward at an addition speed of those speeds. Accordingly, when the driving of the injection electric servomotor 3 and the driving of the injection hydraulic cylinder 5 are controlled appropriately, a low-speed injection step, a high-speed injection step and a pressure intensification step can be carried out.

Next, the configuration of the control unit of the die casting machine according to the first embodiment and a method for controlling the die casting machine using the control unit will be described with reference to FIGS. 2 and 3. The control unit of the die casting machine and the method for controlling the die casting machine according to this embodiment are characterized in that: in the low-speed injection step, the rotational speed of the injection electric servomotor 3 is pattern-controlled to follow a preset speed command pattern while the forward speed of the piston 5*a* caused by the driving of the injection hydraulic cylinder 5 is feedback-controlled with an addition signal of the forward speed of the piston 5*a* caused by the driving of the injection electric servomotor 3 and the forward speed of the piston 5*a* caused by the driving of the injection hydraulic cylinder 5.

In FIG. 2, xij0 designates a motor position command pattern signal indicating the rotational position of the injection electric servomotor 3 which position is converted into the forward position of the piston 5*a*, vij0 designates a motor speed command pattern signal indicating the rotational speed of the injection electric servomotor 3 which speed is converted into the forward speed of the piston 5*a*, vij3 designates a servo-valve total speed setting signal indicating an intended forward speed of the piston 5*a* which speed is converted into the opening degree of the servo-valve 8, and vijff designates a servo-valve command pattern signal indicating the opening degree of the servo-valve 8 which degree is converted into the forward speed of the piston 5*a*. These signals are, for example, supplied from a not-shown host controller.

As shown in FIG. 3(*a*), the motor speed command pattern signal vij0 in this embodiment is set to increase the motor speed from the start of casting to a motor speed v1 required for execution of the low-speed injection step, and then decrease the motor speed to a motor speed v2 before the low-speed injection step is switched to the high-speed injection step. The motor speed v2 to which the motor speed should be decreased is set at an appropriate value with which the injection electric servomotor 3 can be prevented from oscillating when the high-speed injection step is switched to the pressure intensification step. On the other hand, as shown in FIG. 3(*b*), the servo-valve command pattern signal vijff is set at a value with which a shortage v1-v2 of the motor speed in the low-speed injection step can be compensated. As a result, as shown in FIG. 3(*c*), the motor speed v1 required for execution of the low-speed injection step can be secured.

A deviation e1 between the motor position command pattern signal xij0 and a motor position signal xijm measured by the encoder 4 and having passed through a servo-amplifier 15 is obtained by an adder 11 using the motor position signal xijm as a feedback signal. Based on the deviation e1, the rotation of the injection electric servomotor 3 is feedback-controlled.

A PID computing unit 12 computes an operation amount u1 of the injection electric servomotor 3 based on the deviation e1. A speed computing unit 13 computes a speed command v01 based on the operation amount u1. The adder 14 adds the motor speed command pattern signal vij0 which is formed into a feed-forward signal vff1 by a buffer amplifier 16, to the speed command v01, so that a feedback speed command calculated value v01*f* is obtained.

The feedback speed command calculated value v01*f* is supplied to the servo-amplifier 15. The servo-amplifier 15 controls the rotation of the injection electric servomotor 3 in accordance with the feedback speed command calculated value v01*f*. The rotational position of the injection electric servomotor 3 is measured by the encoder 4 attached to the motor 3, and supplied to the adder 11 through the servo-amplifier 15. Thus, the rotational speed of the injection electric servomotor 3 is controlled to follow the motor position command pattern signal xij0.

When the injection electric servomotor 3 is rotationally driven, the rotational motion thereof is converted into rectilinear motion of the hydraulic cylinder 5 by the ball screw mechanism 6 so as to move forward the piston 5*a* provided in the hydraulic cylinder 5. The forward position of the piston 5*a* is detected by the lot sensor 9. A speed calculator 21 calculates the forward speed of the piston 5*a* based on the change of the forward position of the piston 5*a* detected by the lot sensor 9. The output of the speed calculator 21 corresponds to the forward speed of the piston 5*a* caused by the driving of the injection electric servomotor 3 when the injection electric servomotor 3 is driven alone, and corresponds to the addition speed (total speed) of the forward speed of the piston 5*a* caused by the driving of the injection electric servomotor 3 and the forward speed of the piston 5*a* caused by the driving of the injection hydraulic cylinder 5 when the injection electric servomotor 3 and the injection hydraulic cylinder 5 are driven concurrently.

A deviation e3 between the servo-valve total speed setting signal Vij3 and a total speed signal vall of the piston 5*a* is obtained by an adder 22 using the total speed signal vall as a feedback signal. The opening degree of the servo-valve 8 is feedback-controlled based on the deviation e3.

A PID computing unit 23 computes an operation amount u3 of the injection hydraulic cylinder 8 based on the deviation e3. A speed computing unit 24 computes a speed command v03 based on the operation amount u3. An adder 25 adds the servo-valve command pattern signal vijff which is formed into a feed-forward signal vff2 by a buffer amplifier 28, to the speed command v03, so that a feedback speed command calculated value v03*f* is obtained.

The feedback speed command calculated value v03*f* is converted into a speed command v0*ij*3 specific to the servo-valve 8 in accordance with a servo-valve characteristic table 26 stored in the control unit 10. The speed command v0*ij*3 is supplied to a D/A converter 27. Thus, a speed command voltage corresponding to the speed command v0*ij*3 is outputted from the D/A converter 27 so as to adjust the opening degree of the servo-valve 8.

Thus, even if the rotational speed of the injection electric servomotor 3 is reduced in the low-speed injection step and the high-speed injection step, the reduction of the rotational speed can be compensated by the driving of the injection hydraulic cylinder 5 so as to secure the forward speed v1 of the piston 5*a* required for execution of the low-speed injection step and the high-speed injection step. In addition, the forward speed of the piston 5*a* caused by the driving of the injection hydraulic cylinder 5 is feedback-controlled with an addition signal of the forward speed of the piston 5*a* caused by the driving of the injection electric servomotor 3 and the forward speed of the piston 5*a* caused by the driving of the injection hydraulic cylinder 5, so that the rotational speed of the injection electric servomotor 3 when the high-speed injection step is switched to the pressure intensification step can be set at a sufficiently low value. It is therefore possible to prevent the injection electric servomotor 3 from oscillating due to an excessively high rotational speed of the injection electric servomotor 3 when the high-speed injection step is switched to the pressure intensification step. Thus, the boosting pressure in the pressure intensification step can be prevented from fluctuating inappropriately, so that good products can be manufactured with a high yield.

Next, the configuration of a control unit of a die casting machine according to a second embodiment and a method for controlling the die casting machine using the control unit will be described with reference to FIG. 4. The control unit of the die casting machine and the method for controlling the die casting machine according to this embodiment are characterized in that: in the injection step, the forward speed of the piston 5*a* caused by the driving of the injection hydraulic cylinder 5 is pattern-controlled to follow a preset speed command pattern while the rotational speed of the injection electric servomotor 3 is feedback-controlled with an addition signal of the forward speed of the piston 5*a* caused by the driving of the injection electric servomotor 3 and the forward speed of the piston 5*a* caused by the driving of the injection hydraulic cylinder 5.

Figure 4:
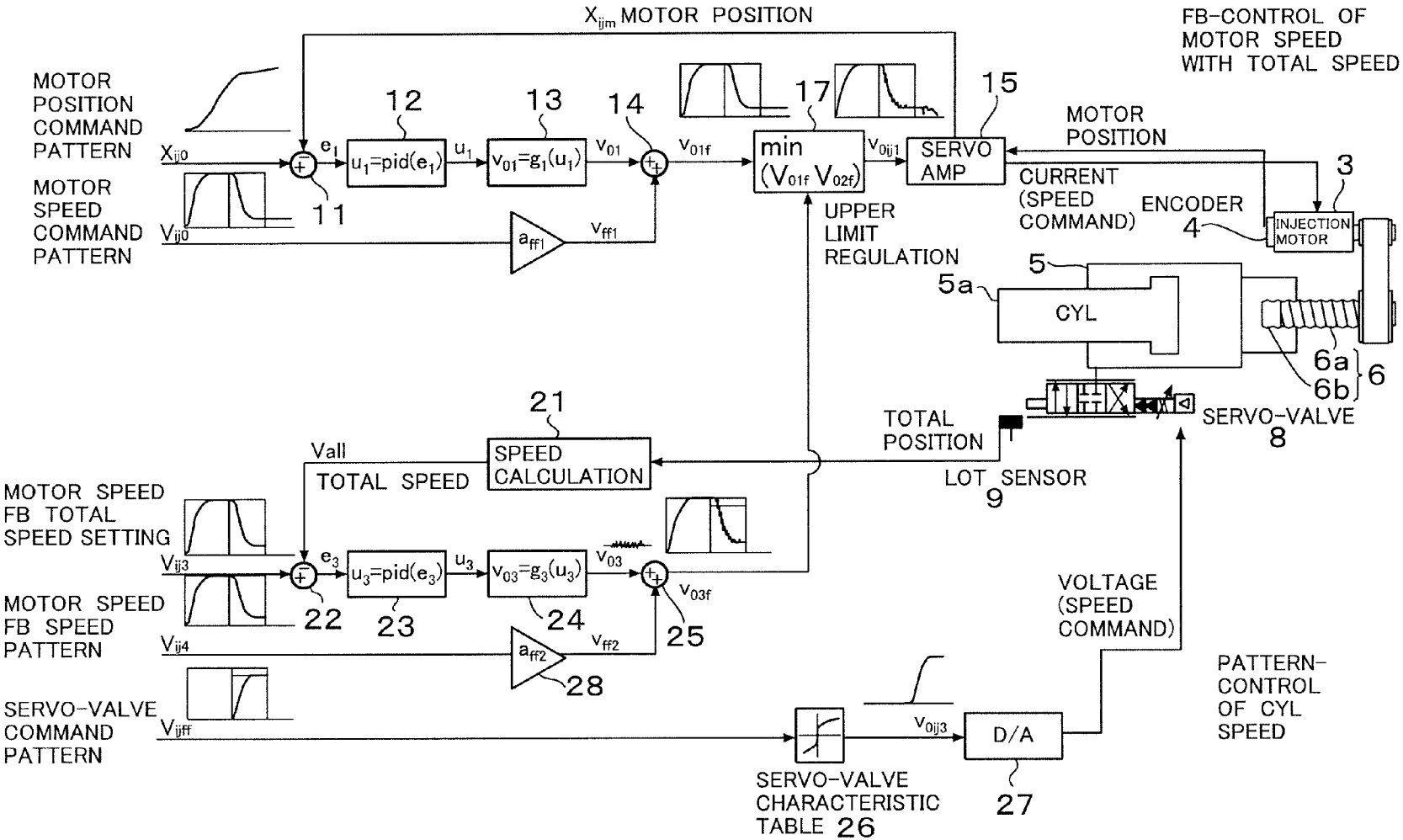
FIG. 4 A control block diagram of a control unit of a die casting machine according to a second embodiment.

As shown in FIG. 4, in addition to the motor position command pattern signal xij0, the motor speed command pattern signal vij0, the servo-valve total speed setting signal vij3 and the servo-valve command pattern signal vijff, a motor speed pattern signal vij4 indicating the reduction of the rotational speed of the injection electric servomotor 3 is supplied from the host controller to the control unit of the die casting machine according to this embodiment.

According to this embodiment, the servo-valve command pattern signal vijff is converted into a speed command v0*ij*3 specific to the servo-valve 8 in accordance with the servo-valve characteristic table 26 stored in the control unit 10. The speed command v0*ij*3 is supplied to the D/A converter 27. A speed command voltage corresponding to the servo-valve command pattern signal vijff is outputted from the D/A converter 27 so as to adjust the opening degree of the servo-valve 8.

A deviation e1 between the motor position command pattern signal xij0 and the motor position signal xijm measured by the encoder 4 and having passed through the servo-amplifier 15 is obtained by the adder 11 using the motor position signal xijm as a feedback signal. Based on the deviation e1, the rotation of the injection electric servomotor 3 is feedback-controlled.

The PID computing unit 12 computes an operation amount u1 of the injection electric servomotor 3 based on the deviation e1. The speed computing unit 13 computes a speed command v01 based on the operation amount u1. The adder 14 adds the motor speed command pattern signal vij0 which is formed into a feed-forward signal vff1 by the buffer amplifier 16, to the speed command v01, so that a feedback speed command calculated value v01*f* is obtained.

A minimum value selector 17 selects a smaller value of the feedback speed command calculated value v01*f* and a feedback speed command calculated value v01*f* which will be described later. The minimum value selector 17 outputs the selected value as a speed command signal v0*ij*1 to the servo-amplifier 15. The servo-amplifier 15 controls the rotation of the injection electric servomotor 3 in accordance with the speed command signal v0*ij*1. The rotational position of the injection electric servomotor 3 is measured by the encoder 4 attached to the motor 3, and supplied to the adder 11 through the servo-amplifier 15. Thus, the rotational speed of the injection electric servomotor 3 is feedback-controlled using the feedback speed command calculated value v03*f* as a feedback signal.

The feedback speed command calculated value v03*f* is generated in the following procedure. That is, a deviation e3 between the total speed setting signal vij3 and the total speed signal vall of the piston 5*a* calculated by the speed calculator 21 based on the position of the piston 5*a* detected by the lot sensor 9 is obtained by the adder 22 using the total speed signal vall as a feedback signal, and the rotation of the electric servomotor 3 is feedback-controlled based on the deviation e3.

The PID computing unit 23 computes an operation amount u3 of the injection hydraulic cylinder 8 based on the deviation e3. The speed computing unit 24 computes a speed command v03 based on the operation amount u3. The adder 25 adds the motor speed pattern signal vij4 which is formed into a feed-forward signal vff2 by the buffer amplifier 28, to the speed command v03, so that a feedback speed command calculated value v03*f* is obtained.

Thus, the rotational speed of the injection electric servomotor 3 is feedback-controlled with an addition signal of the forward speed of the piston 5*a* caused by the driving of the injection electric servomotor 3 and the forward speed of the piston 5*a* caused by the driving of the injection hydraulic cylinder 5. In this manner, in the control unit of the die casting machine according to the embodiment, the rotational speed of the injection electric servomotor 3 is feedback-controlled with an addition signal of the forward speed of the piston 5*a* caused by the driving of the injection electric servomotor 3 and the forward speed of the piston 5*a* caused by the driving of the injection hydraulic cylinder 5, so that the forward speed of the piston 5*a* can be feedback-controlled with high precision.

DESCRIPTION OF REFERENCE NUMERALS

1 base
2 motor mounting plate
3 injection electric servomotor
4 encoder
5 injection hydraulic cylinder
5*a* piston
6 ball screw mechanism
7 accumulator
8 servo-valve
9 lot sensor
10 control unit
11,22 adder
12,23 PID computing unit
13,24 speed computing unit
14,25 adder
15 servo-amplifier
16,28 buffer amplifier
17 minimum value selector
21 speed calculator
26 servo-valve characteristic table
27 D/A converter

The invention claimed is:

1. A die casting machine comprising: an injection electric servomotor; an injection hydraulic cylinder which has a piston; a ball screw mechanism which converts rotational motion of the injection electric servomotor into rectilinear motion and transmits the rectilinear motion to the injection hydraulic cylinder; and a control unit which controls driving of the injection electric servomotor and driving of the injection hydraulic cylinder so as to sequentially execute an injection step including a low-speed injection step and a high-speed injection step following the low-speed injection step, and a pressure intensification step following the injection step; the die casting machine being characterized in that:

the control unit controls the driving of the injection electric servomotor and the driving of the injection hydraulic cylinder during execution of the injection step so that an addition speed of a forward speed of the piston moved in accordance with a rotational speed of the injection electric servomotor and a forward speed of the piston moved in accordance with the driving of the injection hydraulic cylinder can reach an intended speed of the piston.

2. A die casting machine according to claim 1, characterized in that: the control unit comprises:

a means for pattern-controlling the rotational speed of the injection electric servomotor to follow a preset speed command pattern; and a means for feedback-controlling the forward speed of the piston caused by the driving of the injection hydraulic cylinder with an addition signal of the forward speed of the piston caused by the driving of the injection electric servomotor and the forward speed of the piston caused by the driving of the injection hydraulic cylinder.

3. A die casting machine according to claim 1, characterized in that: the control unit comprises:

a means for pattern-controlling the forward speed of the piston caused by the driving of the injection hydraulic cylinder to follow a preset speed command pattern; and a means for feedback-controlling the rotational speed of the injection electric servomotor with an addition signal of the forward speed of the piston caused by the driving of the injection electric servomotor and the forward speed of the piston caused by the driving of the injection hydraulic cylinder.

* * * * *